US007216566B2

(12) United States Patent
Kwak et al.

(10) Patent No.: US 7,216,566 B2
(45) Date of Patent: May 15, 2007

(54) SCREWDRIVER-AND-NUT WRENCH-COMBINED TUNING TOOL FOR RADIO FREQUENCY FILTER

(75) Inventors: Chang-Soo Kwak, Daejon (KR); Man-Seok Uhm, Daejon (KR); In-Bok Yom, Daegu (KR); Ju-Seop Lee, Daejon (KR); So-Hyeun Yun, Daejon (KR)

(73) Assignee: Electronics and Telecommunications Research Institute (KR)

( * ) Notice: Subject to any disclaimer, the term of this patent is extended or adjusted under 35 U.S.C. 154(b) by 0 days.

(21) Appl. No.: 11/452,157

(22) Filed: Jun. 12, 2006

(65) Prior Publication Data

US 2007/0039424 A1 Feb. 22, 2007

(30) Foreign Application Priority Data

Aug. 19, 2005 (KR) ..... 10-2005-0076157

(51) Int. Cl.
*B25B 13/00* (2006.01)

(52) U.S. Cl. ..... 81/13; 81/55; 81/125; 81/451

(58) Field of Classification Search ..... 81/13, 81/55, 56, 125, 138, 165, 451, 9.26, 177.1; 7/138, 165, 167

See application file for complete search history.

(56) References Cited

U.S. PATENT DOCUMENTS

| | | | | |
|---|---|---|---|---|
| 2,007,432 | A * | 7/1935 | Mancuso | 81/55 |
| 2,464,058 | A * | 3/1949 | Rogers | 81/56 |
| 2,566,673 | A * | 9/1951 | Nygaard | 81/452 |
| 3,789,705 | A * | 2/1974 | Naslund | 81/13 |
| 4,914,989 | A * | 4/1990 | Hendricks et al. | 81/462 |

* cited by examiner

*Primary Examiner*—Jacob K. Ackun, Jr.
(74) *Attorney, Agent, or Firm*—Blakely Sokoloff Taylor & Zafman

(57) ABSTRACT

Provides is a screwdriver-and-nut wrench-combined tuning tool for radio frequency filter which is capable of preventing a movement of a tuning screw occurred when locking it with a tuning nut by making their combined body, preventing a difficulty of tuning resulted due to a separate use of a screwdriver and a nut wrench when a space for access to a tuning unit is not sufficient, and minimizing an interruption of turns of the tuning screw and the tuning nut by locking or turning the screwdriver and the nut wrench independently. The screwdriver-and-nut wrench-combined tuning tool for radio frequency filter comprises a case, a nut wrench positioned to rotate inside the case for turning or holding a tuning nut, a screwdriver positioned to rotate inside the nut wrench for turning or holding a tuning screw, a nut wrench locking unit that is fitted to the nut wrench or the case for locking the nut wrench; and a screwdriver locking unitthat is fitted to the case for locking the screwdriver.

11 Claims, 6 Drawing Sheets

SCREWDRIVER-AND-NUT WRENCH-COMBINED TUNING TOOL FOR RADIO FREQUENCY FILTER

FIELD OF THE INVENTION

The present invention relates to a screwdriver-and-nut wrench-combined tuning tool for radio frequency filter; and more particularly, to a tuning tool for radio frequency filter which is capable of enabling a precise tuning and reducing a tuning time by preventing a tuning screw from turning when turning a tuning nut or the tuning nut from turning when turning the tuning screw by means of making a combined body of a screwdriver and a nut wrench used for the tuning of the radio frequency filter and locking them independently.

DESCRIPTION OF RELATED ART

A radio frequency filter is designed to minutely tune its output using a tuning screw and a tuning nut. The output signal varies depending on how deep the tuning screw is inserted into the inside of the radio frequency filter. When a performance of the radio frequency filter reaches to a desired level by the insertion of the tuning screw, it is locked on the radio frequency filter with the tuning nut and then epoxy is applied on a portion with which the tuning screw, the tuning nut and the filter meet for preventing unfastening of the tuning screw and the tuning nut by vibration.

FIG. 1*a* shows a tuning unit arranged in a line and FIG. 1*b* shows a tuning unit arranged in a circle. The tuning screw 3 is locked by moving to the inside or outside of a filter 1 by its turning and then by turning the tuning nut 2 in the same direction as the tuning screw 3.

In a conventional tuning method as shown in FIG. 2, an operator holds a screw driver 20 with a hand and holds a nut wrench handle 11 of a nut wrench 10 with the other hand; and then positions a tuning nut 2 in the inside of a nut locking unit 12. At first, he or she turns and unfastens the tuning nut 2 with the nut wrench 10 by a certain amount. Then he or she moves the tuning screw 3 to the inside or outside of the filter 1 by means of turning the tuning screw 3 with the screw driver 20. When a desired performance is attained, the tuning screw 3 is locked on the filter 1 by turning the tuning nut 2 with the nut wrench 10 keeping the screw 3 from turning with the screwdriver 20.

In the conventional tuning method, however, there occurs a movement of the screwdriver 20 when turning the nut wrench 10 with a hand while holding the tuning screw 3 with the other hand to prevent the tuning screw 3 from moving from a desired position, thereby decreasing the tuning preciseness.

In addition, the tuning screws 3 are arranged at a narrow interval in case of a small sized filter and in a circle in case of a cylindrical filter; and thus, it is difficult for the screwdriver 20 accessing vertically and the nut wrench 10 accessing horizontally to access simultaneously to the tuning unit.

SUMMARY OF THE INVENTION

It is, therefore, an object of the present invention to provide a screwdriver-and-nut wrench-combined tuning tool for radio frequency filter which is capable of preventing a movement of a tuning screw occurred when locking it with a tuning nut by making their combined body, preventing a difficulty of tuning resulted due to a separate use of a screwdriver and a nut wrench when a space for access to a tuning unit is not sufficient, and minimizing an interruption of turns of the tuning screw and the tuning nut by locking or turning the screwdriver and the nut wrench independently.

In accordance with the present invention, there is provided a screwdriver-and-nut wrench-combined tuning tool for radio frequency filter comprising: a case; a nut wrench positioned to rotate inside the case and independently of the case for holding or turning a tuning nut; a screwdriver positioned to rotate inside the nut wrench independently of both the case and the nut wrench for holding or turning a tuning screw; a nut wrench locking unit that is fitted to the nut wrench or the case for locking the nut wrench; and a screwdriver locking unitthat is fitted to the case for locking the screwdriver.

The nut wrench includes a nut-turning unit for holding or turning the tuning nut by holding the outside of the tuning nut; and a turning handle positioned to be exposed onto the upper part of the case and connected to the nut-turning unit. And, the screwdriver includes a screw-turning unit positioned at the inside of the nut wrench and inserted into a groove formed at the tuning screw head for turning or locking the tuning screw.

The outside shape of the case may be of any shape but its inside shape is configured to be cylindrical so that the nut wrench can rotate and the screwdriver and a nut wrench locking unit can be installed thereon.

The nut wrench is provided with a transversal slot so that a screwdriver locking unit installed on the case is configured to pierce the nut wrench and then contact with the screwdriver, thus preventing the screwdriver locking unit from interrupting the turning of the nut wrench.

Other objectives and advantages of the invention will be understood by the following description and will also be appreciated by the embodiments of the invention more clearly. Further, the objectives and advantages of the invention will readily be seen that they can be realized by the means and its combination specified in the claims.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE INVENTION

The above-mentioned objectives, features, and advantages will be more apparent by the following detailed description in association with the accompanying drawings. Hereinafter, a preferred embodiment of the present invention will be set forth in detail with reference to FIGS. 3 to 6.

Figure 1A:
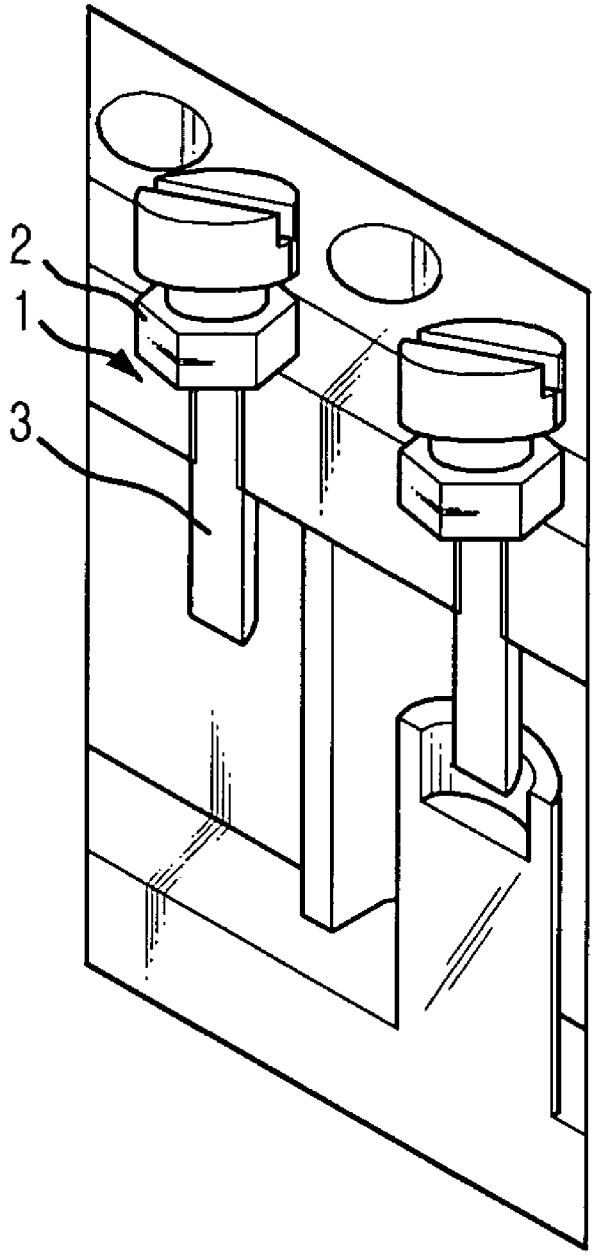
FIGS. 1*a* and 1*b* are partial perspective views showing a tuning unit composed of a radio frequency filter, a tuning screw and a tuning nut.
Figure 1B:
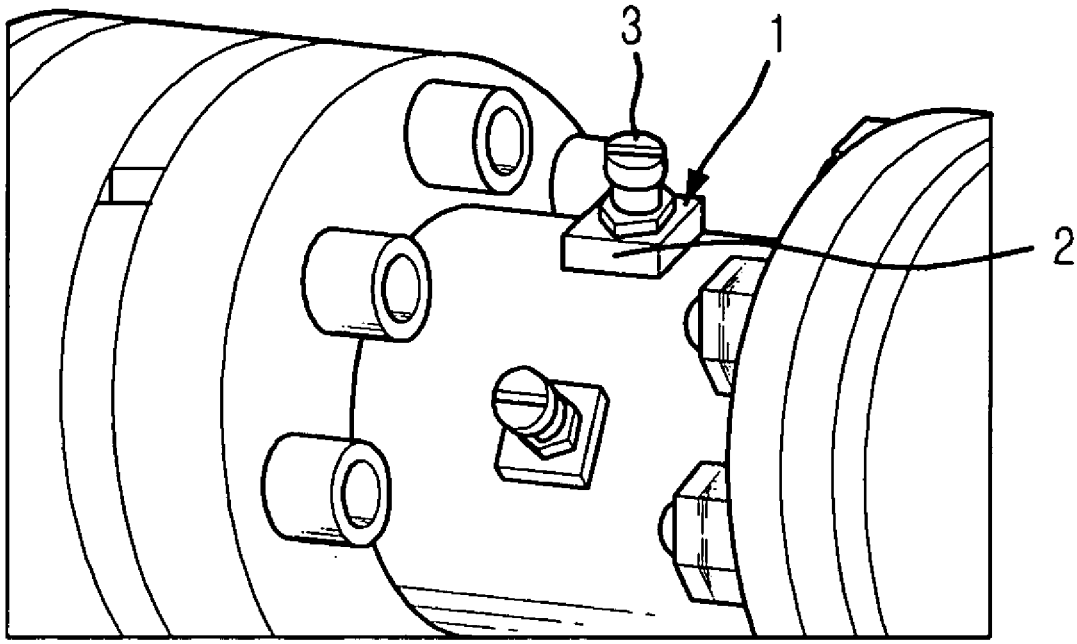
Figure 2:
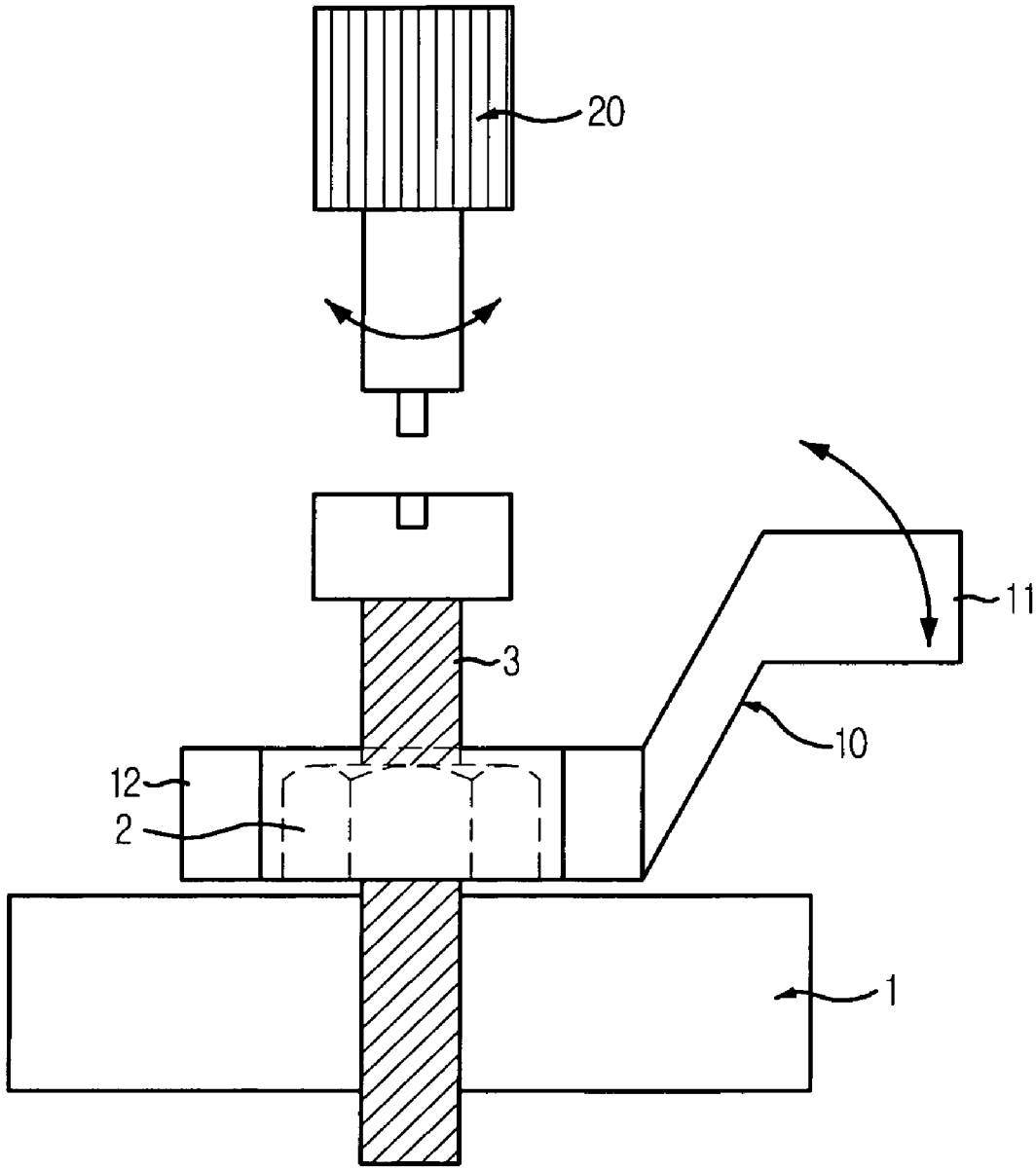
FIG. 2 is a lateral view showing a method for tuning a radio frequency filter using a conventional screwdriver and a nut wrench.
Figure 3:
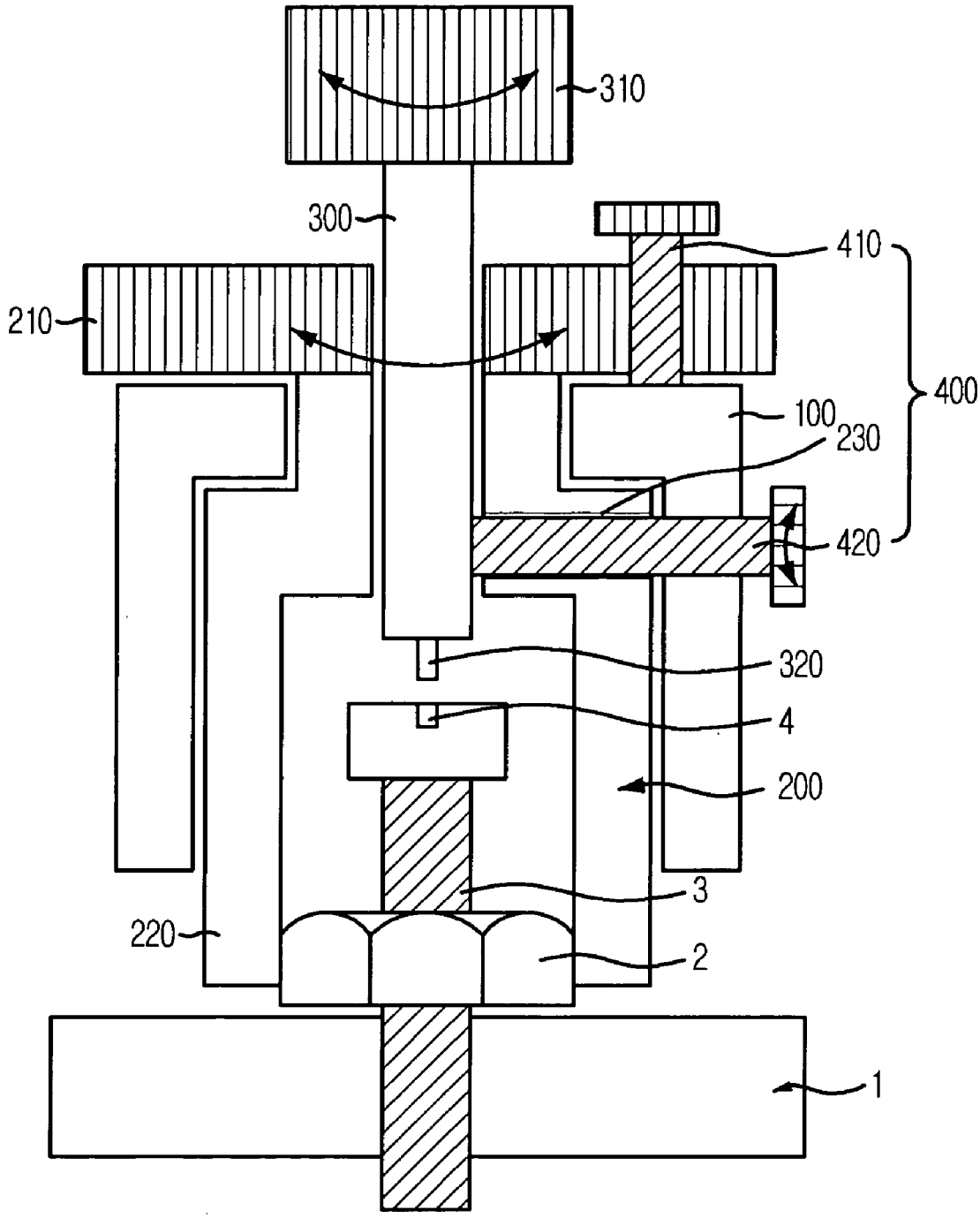
FIG. 3 is a sectional view of a tuning tool for a radio frequency filter in accordance with a first embodiment of the present invention.
Figure 4:
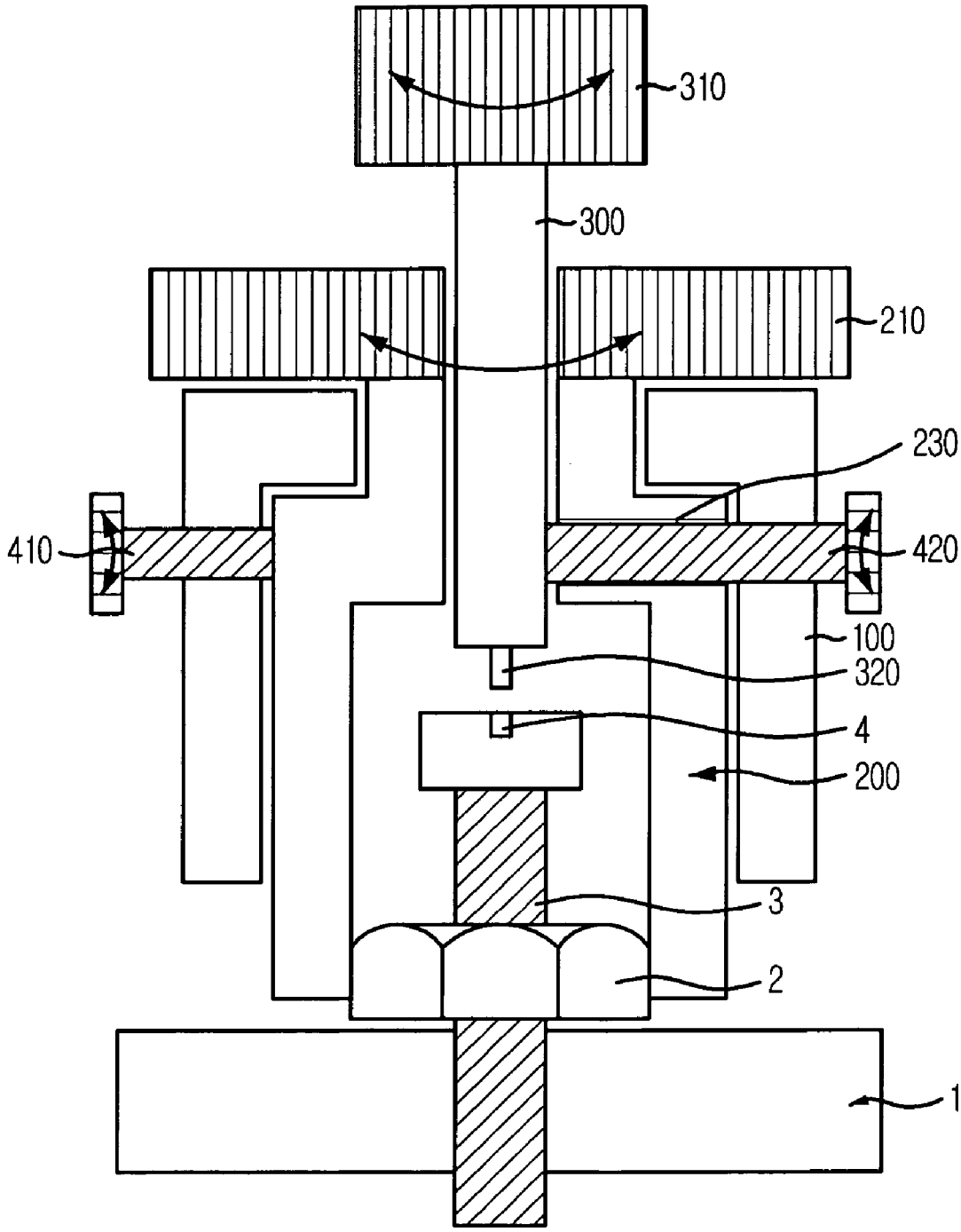
FIG. 4 is a sectional view of a tuning tool for a radio frequency filter in accordance with a second embodiment of the present invention.
Figure 5:
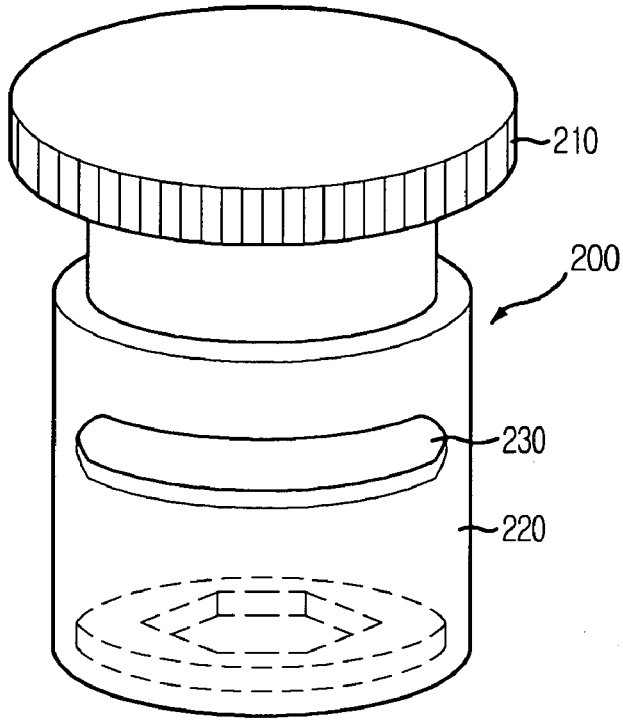
FIG. 5 is a perspective view of a nut wrench in accordance with the present invention.
Figure 6:
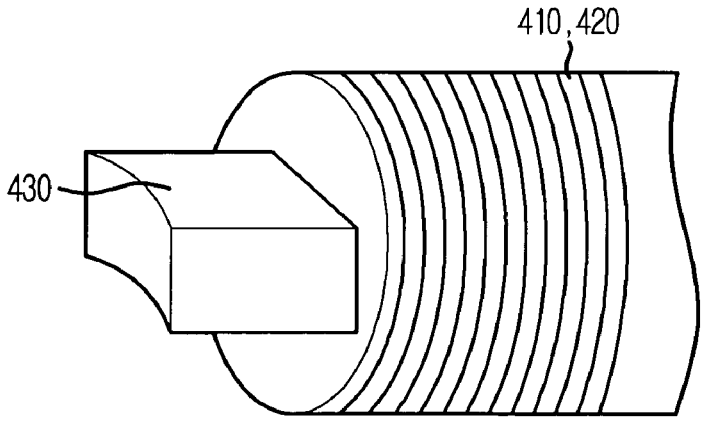
FIG. 6 is a partial perspective view showing a contact portion of a locking unit in accordance with the present invention.

FIG. 3 is a sectional view of a tuning tool for a radio frequency filter in accordance with a first embodiment of the present invention and FIG. 4 is a sectional view of a tuning tool for a radio frequency filter in accordance with a second embodiment of the present invention. And FIG. 5 is a perspective view of a nut wrench in accordance with the present invention and FIG. 6 is a partial perspective view showing a contact portion of a locking unit in accordance with the present invention.

As shown in FIGS. 3 and 4, the present invention comprises a case 100, a nut wrench 200 positioned to rotate inside the case 100 independently of the case for holding or turning a tuning nut 2, a screwdriver 300 positioned to rotate inside the nut wrench 200 independently of both the case and the nut wrench for locking or turning a tuning screw 3 and a nut wrench locking unit that is fitted to the nut wrench or the case for locking the nut wrench; and a screwdriver locking unitthat is fitted to the case for locking the screwdriver.

Specifically, the case 100 is configured to be shorter than the nut wrench 200 so that a tool with a minimum volume can reach the tuning screw 3 and the tuning nut 2, thus enabling easier access thereto.

The nut wrench 200 is a portion that is installed to rotate inside the case 100 independently of the case 100, and conducts the same function as a conventional nut wrench.

The nut wrench 200 includes a nut-turning unit 220 for turning the tuning nut 2 by holding the outside thereof and a turning handle 210 positioned to be exposed onto an upper part of the case 100 and connected to the nut-turning unit 220 for its turning.

The nut-turning unit 220 is formed to correspond to an outer shape of the tuning nut 2 to conduct the same function as a conventional nut locking unit so that the nut-turning unit 220 can unfasten the locked tuning screw 3 by turning the tuning nut 2 and lock the tuning nut 2 to prevent the tuning nut 2 from turning with the tuning screw 3 upon its tuning, and can be detached from the turning handle 210 to be replaceable depending on the size of the tuning nut 2.

The turning handle 210 is exposed onto the outside of the case 100 so that an operator can adjust the tuning nut 2 by turning the nut-turning unit 220 or lock the tuning nut 2 with the nut-turning unit 220.

The outside and inside surfaces of the nut wrench 200 are properly lubricated to enable smooth relative rotational movement with the case 100 and the screwdriver 300.

The screwdriver 300 has a conventional screwdriver shape and can be formed with modified lengths and shapes of a handle when necessary. This screwdriver 300 is inserted to rotate inside the nut wrench 200 and can move up and down axially or be detached completely from the nut wrench 200 so that an operator can easily put the screwdriver 300 in a groove 4 of the tuning screw 3 after confirming an installation angle of the tuning screw 3 prior to inserting the screwdriver 300.

The screwdriver 300 includes a screw-turning unit 320 inserted in the groove 4 formed at the tuning screw 3 for holding or turning the tuning screw 3 and a turning handle 310 positioned to be exposed onto the upper part of the nut wrench 200 and connected to the screw-turning unit 320 for its holding or turning.

The screw-turning unit 320 is inserted to rotate inside the nut wrench 200 and inserted into the groove 4 of the tuning screw 3 upon its tuning. With this structure, tuning is made by turning the tuning screw 3 after the tuning nut 2 is unfastened by the nut wrench 200 and change of a tuned position during a fastening operation of the tuning nut 2 after the tuning is completed is prevented.

The turning handle 310 is positioned to be exposed onto the upper part of the turning handle 210 of the nut wrench 200 so that an operator can adjust the tuning screw 3 by turning the screw-turning unit 320 or prevent change of a tuned position of the tuning screw 3 by locking the screw-turning unit 320.

The locking unit 400 includes a nut wrench locking unit 410 for preventing turning of the nut wrench 200 and a screwdriver locking unit 420 positioned to pierce the case 100 and the nut wrench 200 for locking the screwdriver 300 by pressing one side thereof.

The nut wrench locking unit 410 is configured to pierce the turning handle 210 of the nut wrench 200 and contact with a surface of the case 100 or pierce the case 100 and contact the nut wrench 200 so as to lock the nut wrench 200.

The screwdriver locking unit 420 is configured to pierce the case 100 and the nut wrench 200 sequentially and contact with the screwdriver 300 so as to lock the screwdriver 300.

As shown in FIG. 5, the nut wrench 200 is provided with a penetration slot 230 to allow the screwdriver locking unit 420 to pierce, wherein the penetration slot 230 is formed with a predetermined length to prevent the screwdriver locking unit 420 from interrupting a turning of the nut wrench 200. In this structure, the nut wrench 200 does not need a lot of turning because it is only for a fine tuning of filter.

In addition, each of the exposed portions of the nut wrench locking unit 410 and the screwdriver locking unit 420 has a suitable sized handle with a knurled surface to cause no slip and to put a sufficient torque therein.

Each of the nut wrench locking unit 410 and the screwdriver locking unit 420 may be provided with a contact portion made of a material with a high coefficient of friction at its edge part to be locked by contact with the nut wrench 200 and the screwdriver 300.

Meanwhile, as shown in FIG. 6, the contact portion 430 is configured to correspond to the outside surfaces of the nut wrench 200 and the screwdriver 300 to secure a maximum contact area with the nut wrench 200 and the screwdriver 300.

Now, a method for using the tuning tool of the present invention will be explained hereinafter.

First, it is assumed that an operator is a righthanded person. And then, the nut wrench 200 holds the tuning nut 2, and the screwdriver 300 is inserted in the groove of the tuning screw 3 while inserting the screwdriver 300 in the nut wrench 200; and subsequently the tuning screw 3 and the tuning nut 2 are unfastened by turning the nut wrench 200 and the screwdriver 300 by a certain angle. Next, tuning is achieved by using the screwdriver 300 with the right hand while holding the case 100 with the left hand, and then the screwdriver 300 is locked by using the screwdriver locking unit 420 with the right hand.

Thereafter, the tuning screw 3 is locked by turning the tuning nut 2 while holding the turning handle 210 of the nut wrench 200 with the right hand. In addition, when needed, it is possible to fasten or unfasten the tuning screw 3 and the tuning nut 2 together under a state that the screwdriver 300 and the nut wrench 200 are locked. And also, it is possible to fasten or unfasten either of the tuning screw 3 and the tuning nut 2, under a state of holing the screwdriver 300 and the nut wrench 200 with both hands, respectively.

The present invention as described early can enable a tuning operation in a small space by forming a screwdriver-and-nut wrench combined tuning tool and also enhance a tuning efficiency by preventing a tuning screw from turning when turning a tuning nut and a tuning nut from turning when turning a tuning screw by means of preventing mutual influence when turning a screwdriver or a nut wrench.

The present application contains subject matter related to Korean patent application No. 2005-76157, filed with the Korean Intellectual Property Office on Aug. 19, 2005, the entire contents of which are incorporated herein by reference.

While the present invention has been described with respect to the particular embodiments, it will be apparent to those skilled in the art that various changes and modifications may be made without departing from the spirit and scope of the invention as defined in the following claims.

What is claimed is:

1. A screwdriver-and-nut wrench-combined tuning tool for radio frequency filter, comprising:

a case;

a nut wrench positioned to rotate inside the case for holding or turning a tuning nut;

a screwdriver positioned to rotate inside the nut wrench for holding or turning a tuning screw;

a nut wrench locking unit that is fitted to the nut wrench or the case for locking the nut wrench; and a screwdriver locking unitthat is fitted to the case for locking the screwdriver.

2. The screwdriver-and-nut wrench-combined tuning tool for radio frequency filter as recited in claim 1, wherein the nut wrench includes:

a nut-turning unit for holding or turning the tuning nut by holding an outside of the tuning nut; and a turning handle positioned to be exposed onto an upper part of the case and connected to the nut-turning unit for turning or locking the nut-turning unit.

3. The screwdriver-and-nut wrench-combined tuning tool for radio frequency filter as recited in claim 2, wherein the nut-turning unit is configured to detach from the turning handle to be replaceable depending on a size of the tuning nut.

4. The screwdriver-and-nut wrench-combined tuning tool for radio frequency filter as recited in claim 1, wherein the screwdriver includes:

a screw-turning unit positioned inside the nut wrench and inserted into a groove formed at the tuning screw for turning or locking the tuning screw; and a turning handle positioned to be exposed onto the upper part of the nut wrench and connected to the screw-turning unit for turning or locking the screw-turning unit.

5. The screwdriver-and-nut wrench-combined tuning tool for radio frequency filter as recited in claim 2, wherein the screwdriver is disposed to be moved up and down inside the nut wrench and also to be detached from the nut wrench.

6. The screwdriver-and-nut wrench-combined tuning tool for radio frequency filter as recited in claim 1, wherein the locking unit includes:

a nut wrench locking unit for preventing the turning of the nut wrench; and a screwdriver locking unit positioned to pierce the case and the nut wrench for preventing the turning of the screwdriver by pressing one side of the screwdriver.

7. The screwdriver-and-nut wrench-combined tuning tool for radio frequency filter as recited in claim 6, wherein the first locking member is configured to pierce the turning handle of the nut wrench and then contact with one surface of the case.

8. The screwdriver-and-nut wrench-combined tuning tool for radio frequency filter as recited in claim 6, wherein the nut wrench locking unit is configured to pierce the case and then lock one side of the nut wrench.

9. The screwdriver-and-nut wrench-combined tuning tool for radio frequency filter as recited in claim 6, wherein the nut wrench is configured to have a penetration slot of predetermined length to allow the screwdriver locking unit to pierce.

10. The screwdriver-and-nut wrench-combined tuning tool for radio frequency filter as recited in claim 6, wherein each of the nut wrench locking unit and the screwdriver locking unit has a contact portion made of a material with a high coefficient of friction at its end part contacting with the nut wrench, the screwdriver and the case.

11. The screwdriver-and-nut wrench-combined tuning tool for radio frequency filter as recited in claim 10, wherein the contact portion is configured to have a shape corresponding to the contact surfaces of the nut wrench, the screwdriver and the case to secure a sufficient contact area.

* * * * *